United States Patent [19]

Takahashi et al.

[11] 4,280,213

[45] Jul. 21, 1981

[54] QUICK FEEDING SYSTEM FOR A COUNTER

[75] Inventors: Masayuki Takahashi; Hideo Monma, both of Kawasaki, Japan

[73] Assignee: Fujitsu Limited, Kawasaki, Japan

[21] Appl. No.: 94,435

[22] Filed: Nov. 15, 1979

[30] Foreign Application Priority Data

Nov. 17, 1978 [JP] Japan ..... 53-142532

[51] Int. Cl.[3] ..... G04C 9/00

[52] U.S. Cl. ..... 368/187

[58] Field of Search ..... 58/23 R, 855; 368/69, 368/70, 187, 188

[56] References Cited

U.S. PATENT DOCUMENTS

| | | | |
|---|---|---|---|
| 3,928,959 | 12/1975 | Naito | 58/23 R |
| 3,948,035 | 4/1976 | Kusumoto | 58/23 R |

*Primary Examiner*—Vit W. Miska

*Attorney, Agent, or Firm*—Staas & Halsey

[57] ABSTRACT

A quick feeding system for feeding quick counting pulses to a counter, such as an hours counter of an electronic clock of the digital display type, comprising frequency dividing circuits, a switch for effecting a quick feed of pulses to the counter and a quick feed pulse generation circuit connected between one of the frequency dividing circuits and the counter.

3 Claims, 10 Drawing Figures

DIVIDER
FF
D
Q
Q̄
1
1a
21
22
23
24
3
31
32
33
34
221
222
223
231
232
233
241

QUICK FEEDING SYSTEM FOR A COUNTER

BACKGROUND OF THE INVENTION

The present invention relates to a quick feeding system, and more particularly to a quick feeding system for feeding quick counting pulses to counters used for counting seconds, minutes, hours and the like in an electronic clock of the digital display type.

An example of prior art systems for feeding quick feed pulses to a counter of an electronic clock is illustrated in FIG. 1 attached to the present specification. The prior art system comprises a quartz oscillation circuit 1 including a quartz oscillation element 1*a* the frequency of which is 6.5 MHz, a first frequency dividing circuit 21 the output frequency of which is 50 Hz, a second frequency dividing circuit 22 the output frequency of which is 10 Hz, a third frequency dividing circuit 23 the output frequency of which is 2 Hz, a fourth frequency dividing circuit 24 the output frequency of which is 1 Hz, an AND gate 3', a quick feed input circuit 4', a switching circuit 6', a seconds counter 71, a minutes counter 81 and an hours counter 91. In this example, a quick feeding to the hours counter 91 is effected.

The output of the frequency dividing circuit 24 of 1 Hz is supplied to a second input of OR gate 63' in the switching circuit 6' through the seconds counter 71 and the minutes counter 81. A quick feed signal $HS_1$ is produced by switching on a manual switch 42' in the quick feed input circuit 4'. The signal $HS_1$ is supplied to a chattering preventing delay flip-flop circuit (D-flip-flop circuit) 46', controlled by the output of the frequency dividing circuit 24, which eliminates chattering of the signal $HS_1$ due to the operation of the manual switch 42'. An output $HS_2'$ of the quick feed input circuit 4' is supplied to the switching circuit 6'. The switching circuit 6' supplies either a carry signal from the minutes counter 81 to the hours counter 91 or a quick feed pulse 621' of 2 Hz from the AND gate 3' to the hours counter 91 in accordance with the signal $HS_2'$ from the quick feed input circuit 4'. The hours counter 91 counts the incoming clock pulses from the switching circuit 6' and supplies the output signals to a display device 93 through a decoder 92.

The operation of the system of FIG. 1 will now be described with reference to the wave forms illustrated in FIGS. 2A, 2B, 2C and 2D. FIGS. 2A and 2B illustrate the case where the level of the second input signal 631' of the OR gate 63' is "1" and FIGS. 2C and 2D illustrate the case where the level of the second input signal 631' of the OR gate 63' is "0".

If the switch 42' is caused to close a bit prior to the falling edge of the pulse 451' of 1 Hz under the condition when the level of the signal 631' is "1", the signal 911 is caused to fall simultaneously with the falling of the pulse 451'. Accordingly, the hours counter 91 counts "+1" only a very short time ($t_s'$) after the closing of the switch 42', as illustrated in FIG. 2A. But, if the switch 42' is caused to close a bit after the falling edge of the pulse 451' of 1 Hz under the condition when the level of the signal 631' is "1", the signal 911 is caused to fall at the next falling edge of the pulse 451'. Accordingly, the hours counter 91 counts "+1" after a time "$t'_1$", which is approximately 1 second, from the closing of the switch 42', as illustrated in FIG. 2B.

If the switch 42' is caused to close a bit prior to the falling edge of the pulse 451' of 1 Hz under the condition when the level of the signal 631' is "0", the signal 911 appears after a time $t_2'$, which is approximately 0.5 second, from the closing of the switch 42', as illustrated in FIG. 2C. But, if the switch 42' is caused to close a bit after the falling edge of the pulse 451' of 1 Hz under the condition when the level of the signal 631' is "0", the signal 911 appears after a time $t_3'$, which is approximately 1.5 seconds from the closing of the switch 42', as illustrated in FIG. 2D.

Therefore, in the prior art system of FIG. 1, the interval from the closing of the switch 42' to the actual quick feeding of the hours counter varies from $t_s'$, which is approximately zero, to $t_3'$, which is approximately 1.5 seconds, in accordance with the relative time of the closing of the switch 42' with respect to the falling edge of the pulse 451' of 1 Hz. As a result, in the case where it is only necessary to increment the hours counter by a few hours is needed, there is a disadvantage in that an excessive number of quick feeding pulses are apt to be supplied to the hours counter 91 so that the hours counter 91 is apt to be excessively incremented.

SUMMARY OF THE INVENTION

An object of the present invention is to eliminate the above explained disadvantage.

It is the principal object of the invention to feed a quick feeding pulse to a time counter after a predetermined length of time regardless of the relative time of the closing of the switch of the quick feed input circuit.

DETAILED DESCRIPTION OF THE PREFERRED EMBODIMENT

Figure 1A:
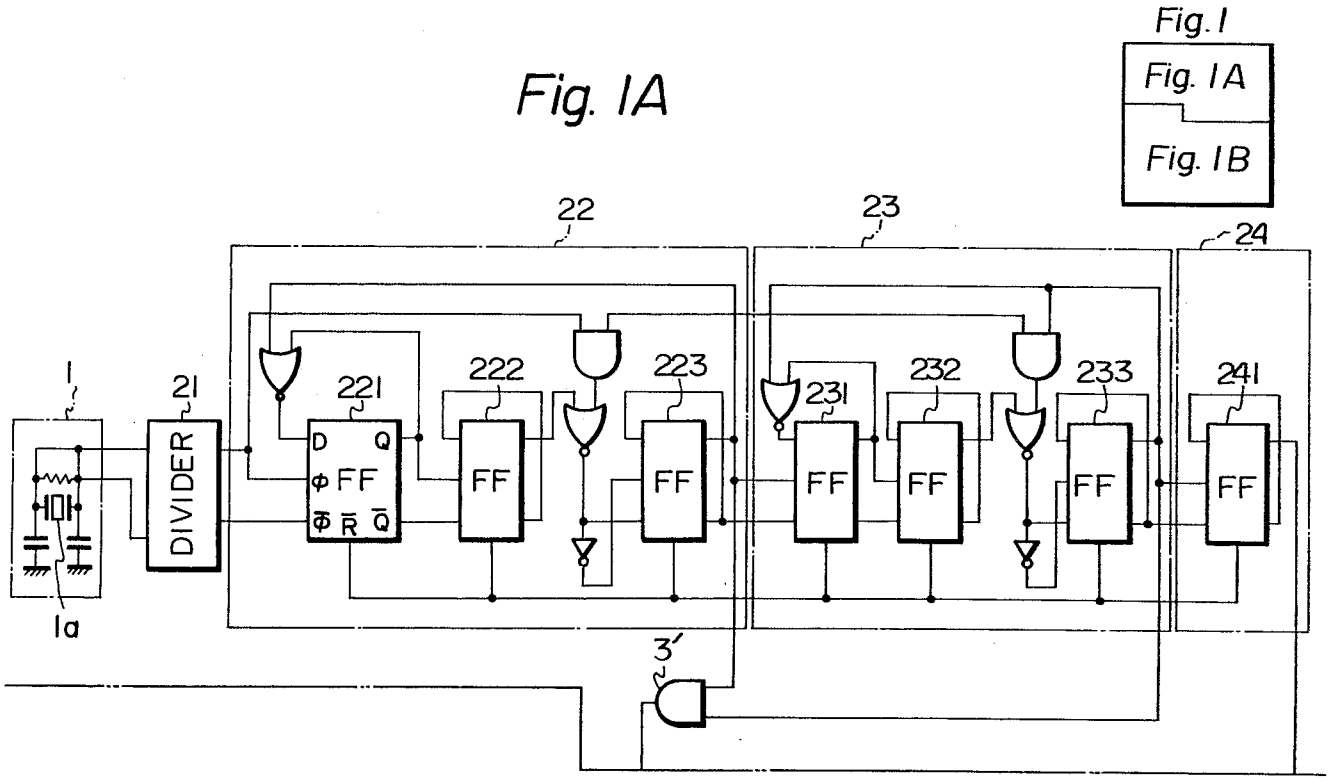
FIGS. 1A and 1B illustrate a prior art system for feeding quick feed pulses to a time counter of an electronic clock.
Figure 1B:
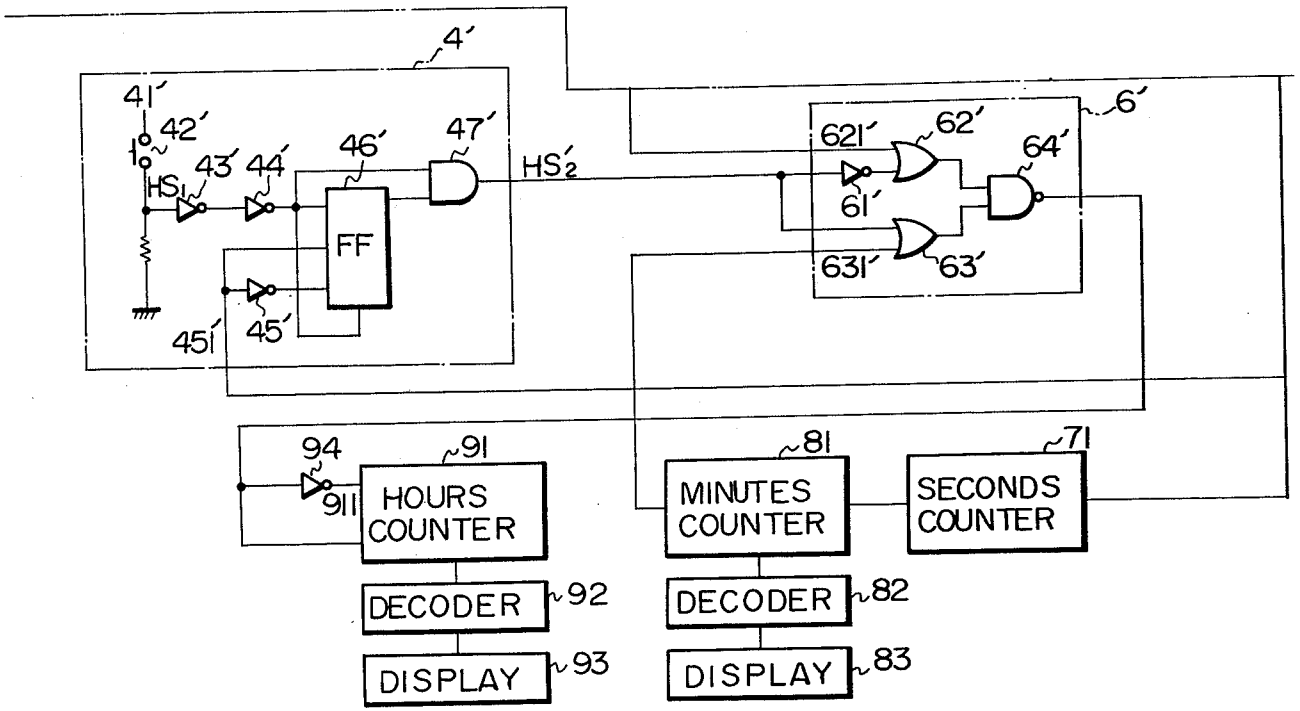
Figure 2A:
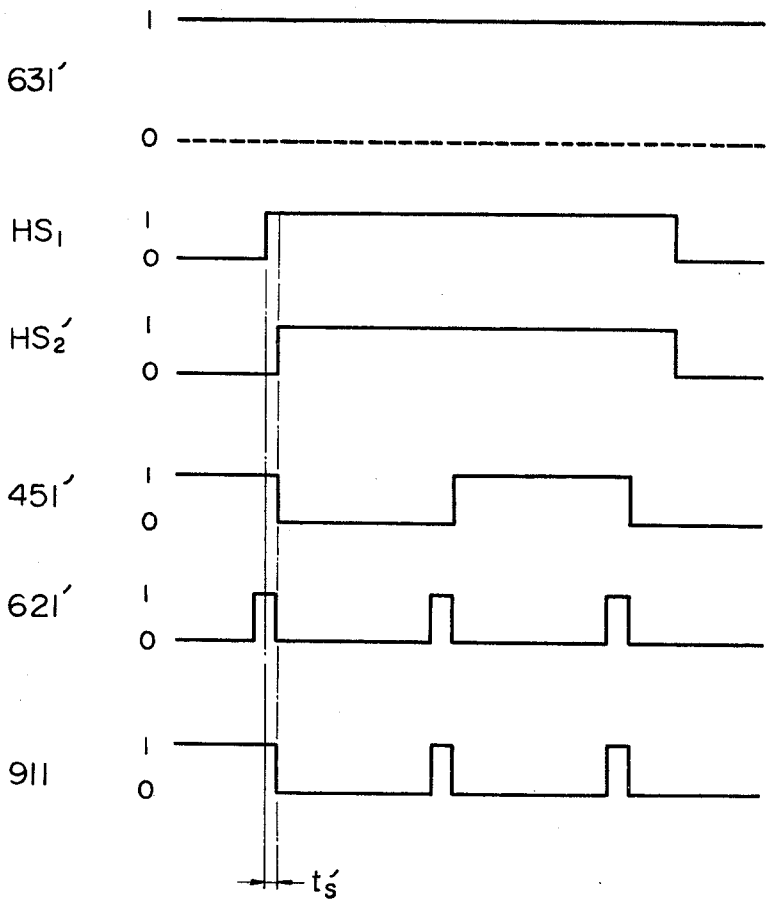
FIGS. 2A, 2B, 2C and 2D are graphs illustrating the operation of the system of FIGS. 1A and 1B.
Figure 2B:
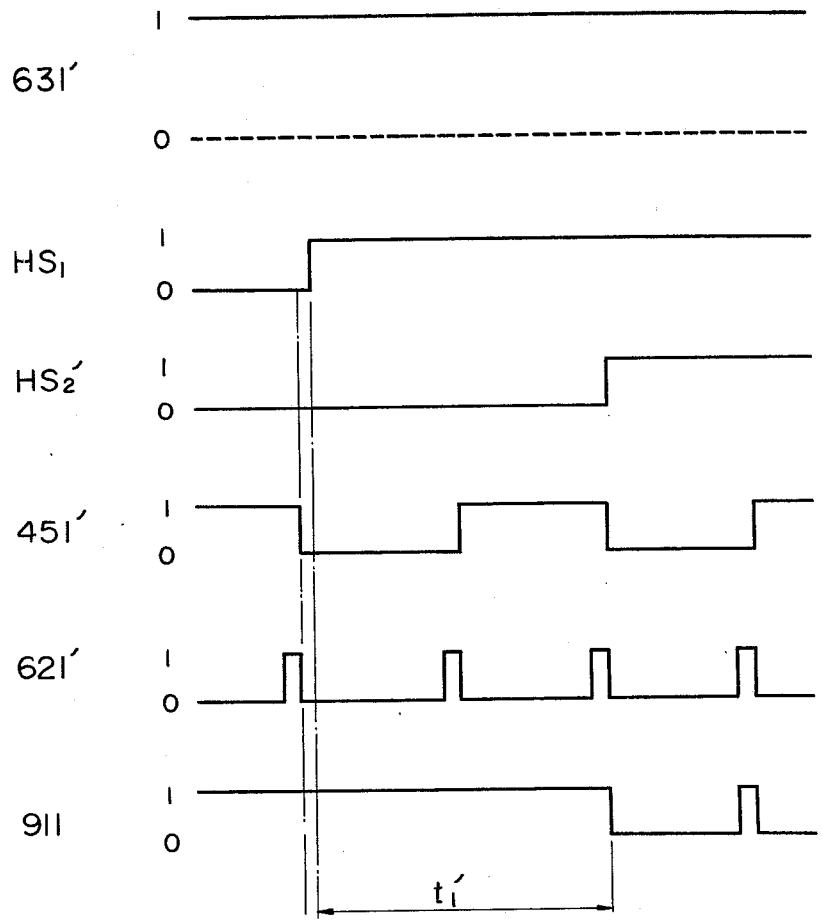
Figure 2C:
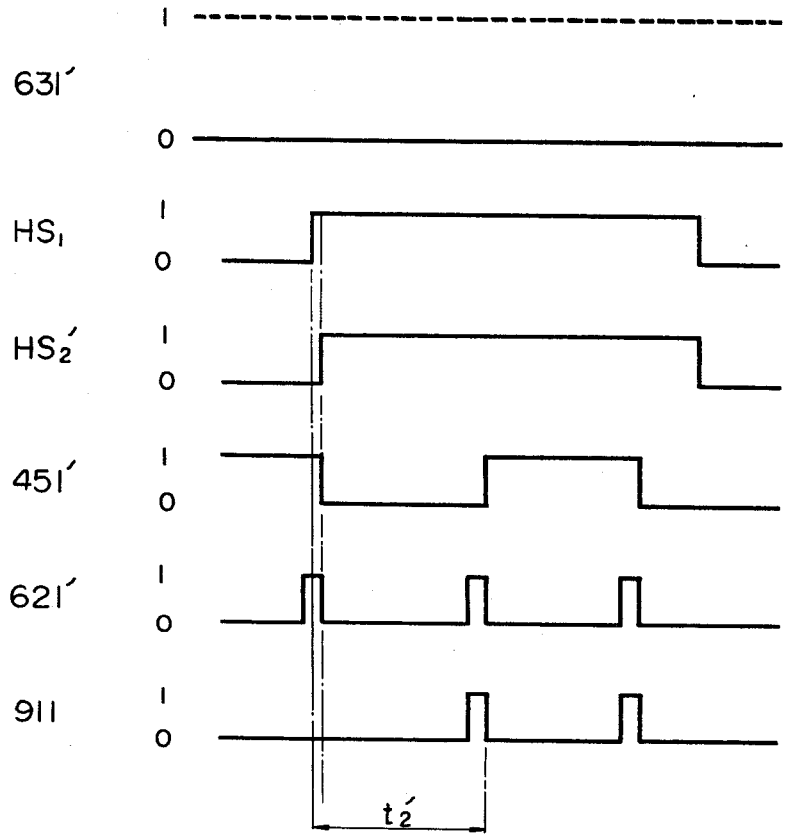
Figure 2D:
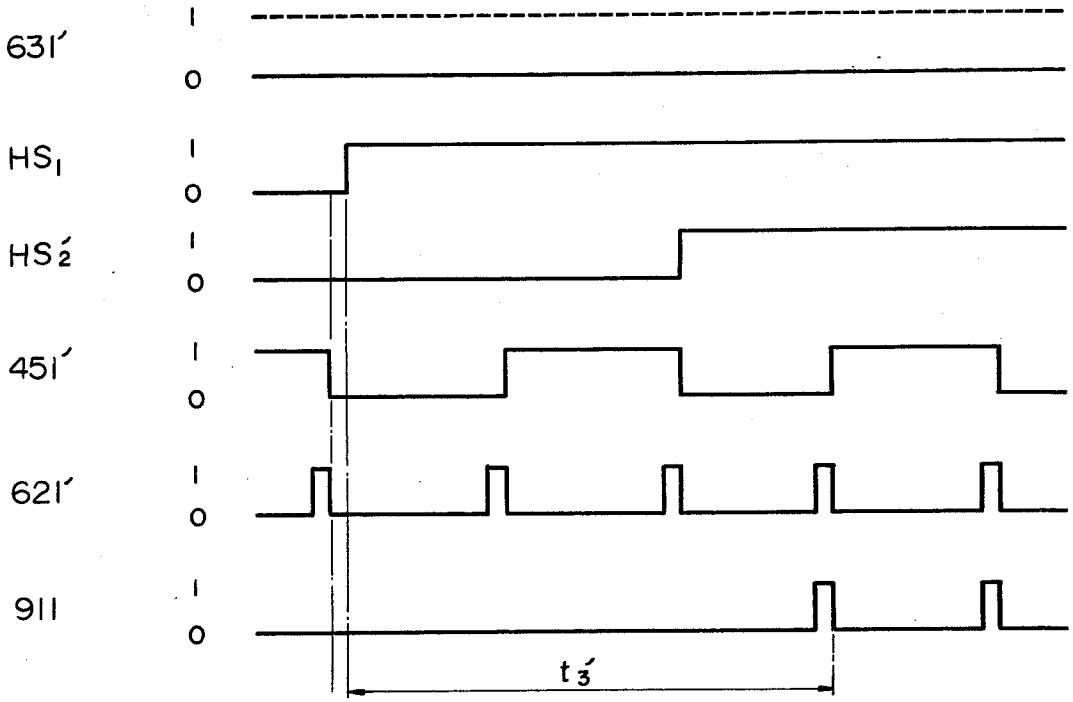
Figures 3, 3A, 3B:
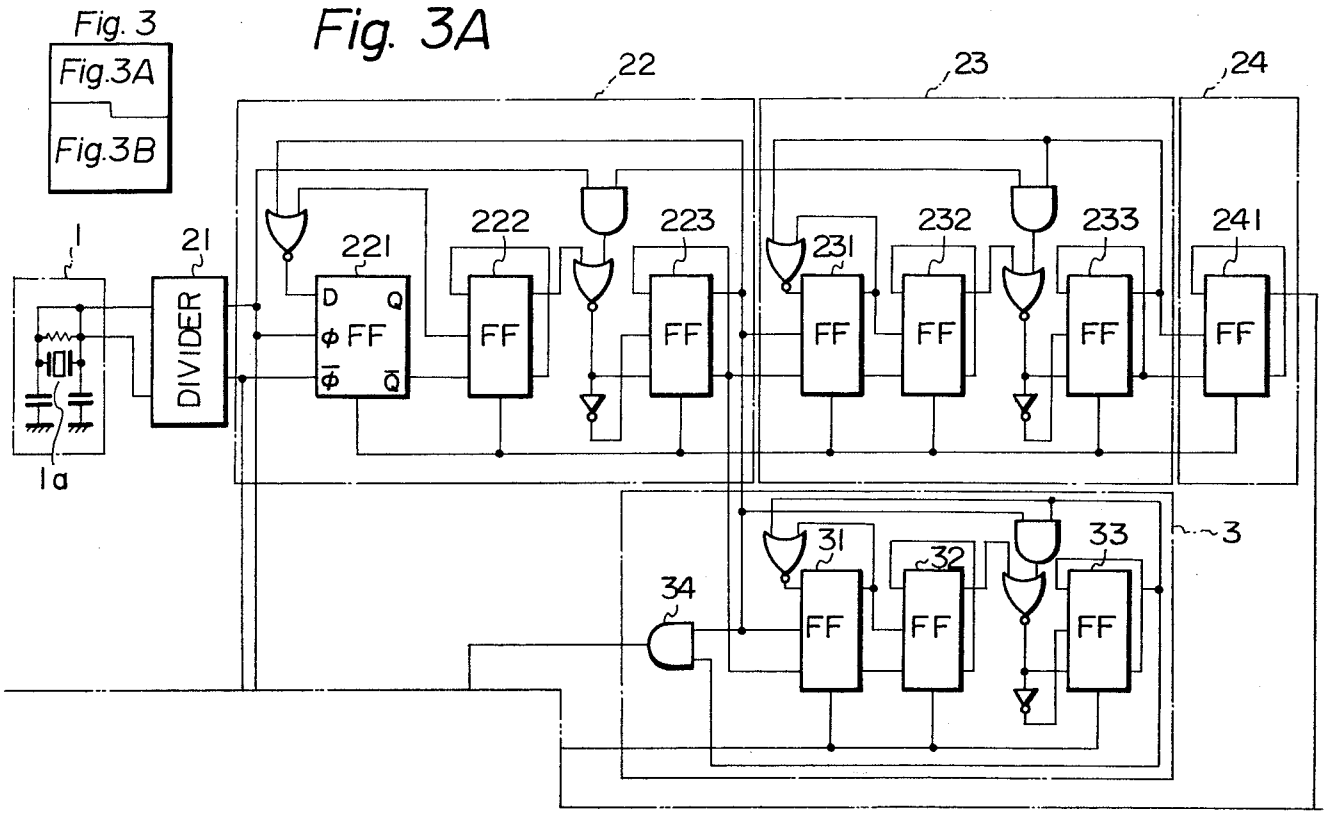
FIGS. 3A and 3B illustrate a system for feeding quick feed pulses to a time counter of an electronic clock in accordance with an embodiment of the present invention.
Figure 3B:
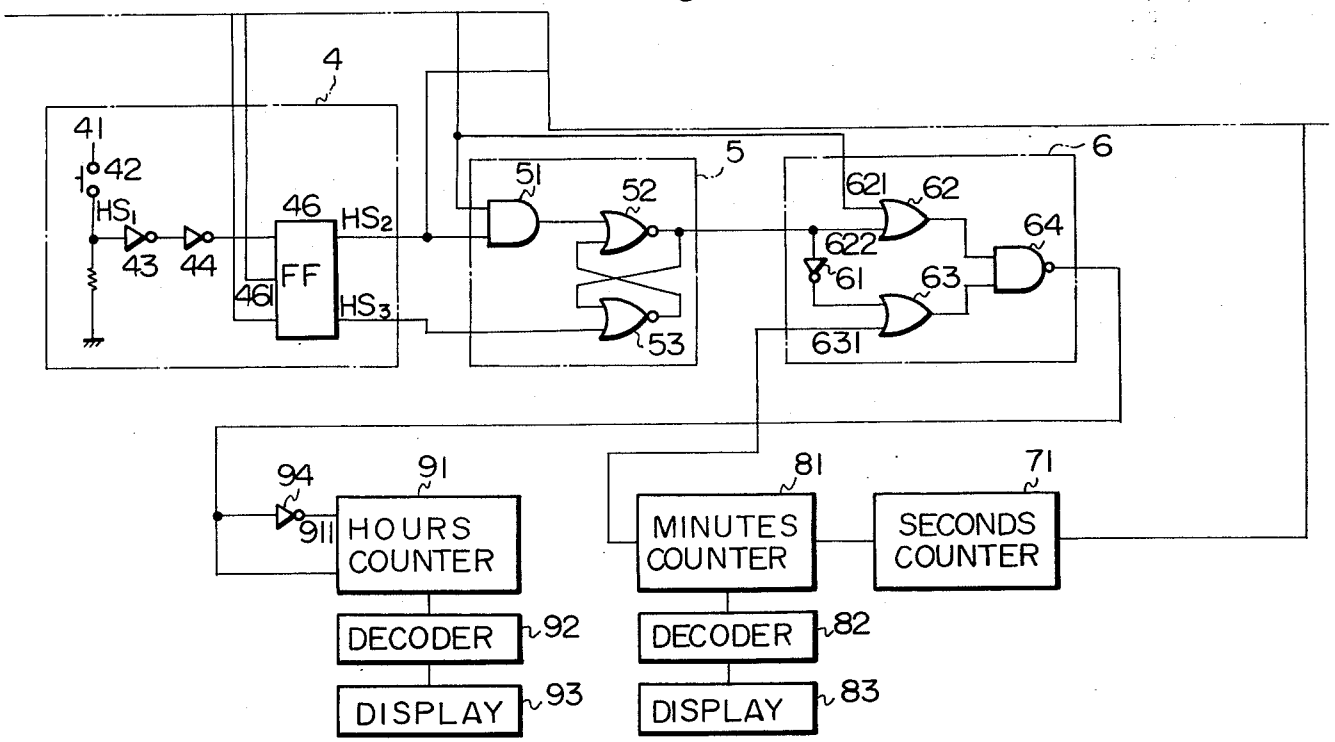

In FIG. 3, a quartz oscillation circuit 1, a first frequency dividing circuit 21, a second frequency dividing circuit 22, a third frequency dividing circuit 23 and a fourth frequency dividing circuit 24 are the same as those in FIG. 1. In the system of FIG. 3, a quick feed pulse generation circuit 3 and a switching time control circuit 5 are provided. The quick feed pulse generation circuit 3, which comprises a frequency dividing circuit, receives an input signal of 10 Hz produced from the frequency dividing circuit 22 and produces a sequence of 2 $H_z$ quick feed pulses as output signals.

In the case where a manual switch 42 in a quick feed input circuit 4 is open, the Q-output signal $HS_2$ of a D-flip-flop circuit 46, which is supplied to the reset inputs of the D-flip-flop circuits 31, 32 and 33, is "0" so that the D-flip-flop circuits 31, 32 and 33 are caused to be reset and accordingly no quick feed pulses are produced from the quick feed pulse generation circuit 3. When the manual switch 42 is caused to close, the Q-output signal $HS_2$ of the D-flip-flop circuit 46 turns to "1" so that the reset of the D-flip-flop circuits 31, 32 and 33 are released and accordingly the quick feed pulse generation circuit 3 commences to produce a sequence of quick feed pulses. This sequence of quick feed pulses is supplied via the switching time control circuit 5 and the switching circuit 6 to the hours counter 91 as input signals 911. Accordingly, the hours counter 91 counts the input pulses and supplies the output signals to a display device 93 through a decoder 92.

The switching circuit 6, which selects either quick feed pulses from the quick feed pulse generation circuit 3 or the output signals from the minutes counter 81, is controlled by the switching time control circuit 5 which acts as a latch circuit. The switching time control circuit 5 is set by the output signal of an AND gate 51 which receives an input signal of the quick feed pulse from the quick feed pulse generation circuit 3 and an input signal of the Q-output $HS_2$ of the D-flip-flop circuit 46 of the quick feed input circuit 4, so that the switching time control circuit 5 makes the switching circuit 6 pass the quick feed pulses from the quick feed pulse generation circuit 3. Also, the switching time control circuit 5 is caused to be reset by the Q-output $HS_3$ of the D-flip-flop circuit 46 of the quick feed input circuit 4, so that the switching time control circuit 5 makes the switching circuit 6 pass the output signals from the minutes counter 81.

Figure 4A:
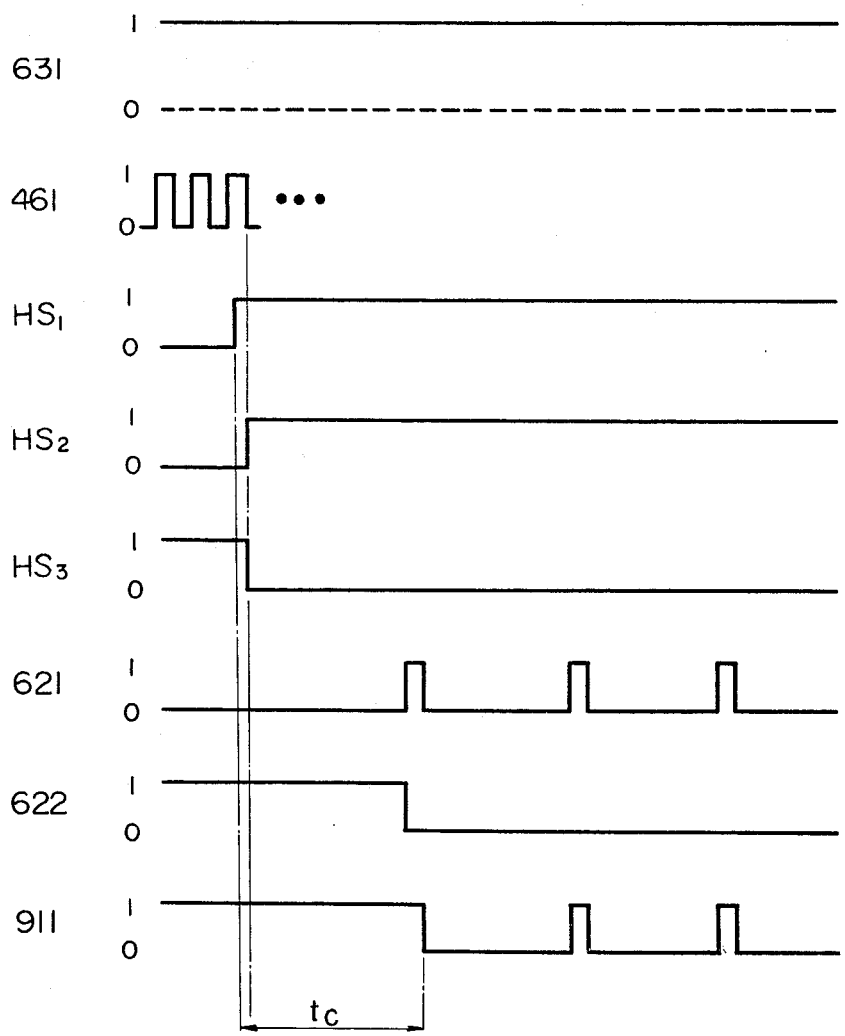
FIGS. 4A and 4B are graphs illustrating the operation of the system of FIGS. 3A and 3B.
Figure 4B:
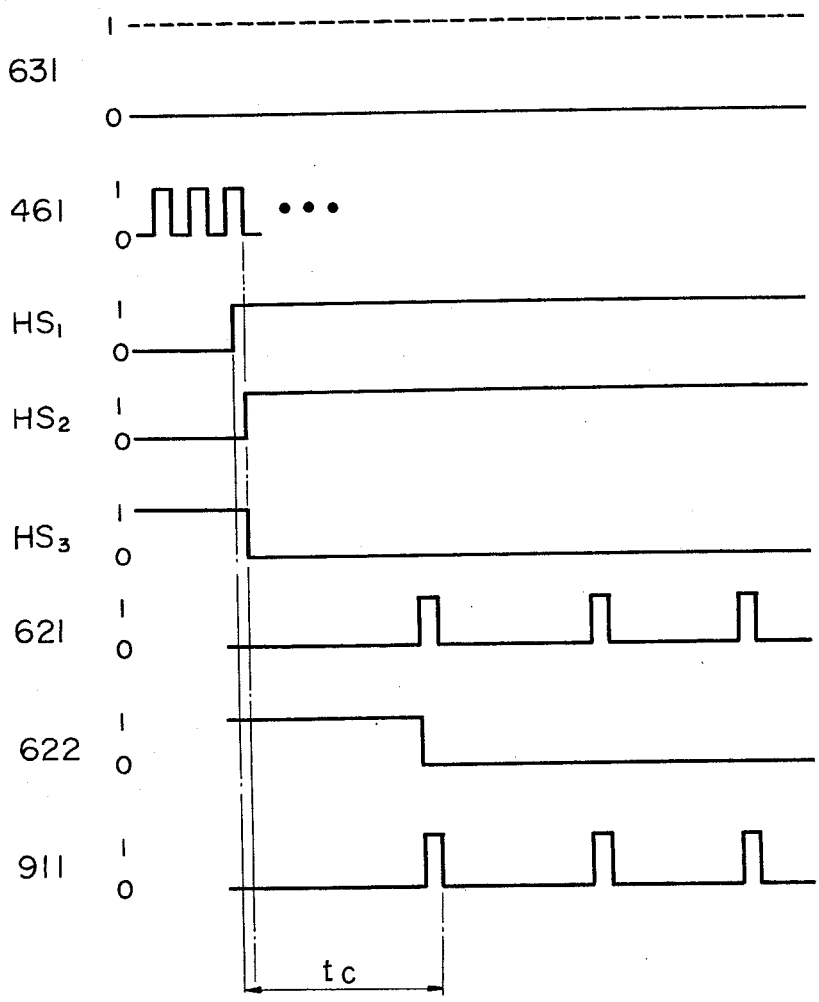

The wave forms shown in FIGS. 4A and 4B illustrate the operation of the system of FIG. 3. The level of the input signal 631 is "1" in FIG. 4A and "0" in FIG. 4B. In both cases of FIGS. 4A and 4B, a falling of the level of the input signal 911 of the hours counter 91 occurs at the time the level of the signal 621 falls after a status in which both levels of the signal $HS_2$ and the level of the signal 621 are "1". Since the quick feed pulse is produced after a release of the reset state of the D-flip-flop circuits 31, 32 and 33 of the quick feed pulse generation circuit 3 after the closing of the switch 42, it takes a length of time $t_c$ from the closing of the switch 42 to the feeding of the quick feed pulse to the hours counter 91, and the length of time $t_c$ is of a constant value of approximately 0.4 to 0.5 second. By using the system of FIG. 3, therefore, it is possible to eliminate the disadvantage that an excessive number of quick feeding pulses are apt to be supplied to the hours counter 91.

What is claimed is:

1. A counting system comprising:

an oscillator circuit for generating an oscillation signal;

a frequency divider circuit, operatively connected to said oscillator circuit, for receiving said oscillation signal and for generating first and second frequency divided signals;

a quick-feed input circuit, having a switch, for generating first and second output signals in dependence upon the actuation of said switch;

a quick-feed pulse generator circuit, operatively connected to said frequency divider circuit and said quick-feed input circuit, for receiving said first output signal and said second frequency divided signal and for generating a quick-feed pulse signal;

a switching time control circuit, operatively connected to said quick-feed input circuit and said quick-feed pulse generator circuit, for providing a control signal in dependence upon said quick-feed pulse signal and said first and second output signals;

counter and display means, operatively connected to said frequency divider circuit, for receiving said first frequency divided signal and for generating a counted output signal; and a switching circuit, operatively connected to said quick-feed pulse generator circuit, said switching time control circuit and said counter and display means, for providing, as a switching output signal to said counter and display means, either said quick-feed pulse signal or said counted output signal in dependence upon said control signal;

said switching circuit providing said quick-feed pulse signal a predetermined constant time after the closing of said switch in said quick-feed input circuit;

said counter and display means for counting said first frequency divided signal and said switching output signal and for displaying the counted result.

2. A counting system as set forth in claim 1, wherein said switching time control circuit comprises:

a first AND gate having a first input connected to the output of said quick-feed pulse generator circuit for receiving said quick-feed pulse signal, having a second input connected to said quick-feed input circuit for receiving said first output signal, and having an output;

a first NOR gate having a first input connected to the output of said first AND gate, having a second input and having an output connected to said switching circuit for providing said control signal; and a second NOR gate having a first input connected to the output of said first NOR gate, having a second input connected to said quick-feed input circuit for receiving said second output signal, and having an output connected to the first input of said first NOR gate.

3. A counting system as set forth in claim 1 or 2, wherein said quick-feed pulse generator circuit comprises:

a second AND gate having a first input connected to said frequency divider circuit for receiving said second frequency divided signal, having a second input, and having an output connected to said switching time control circuit and said switching circuit, said output providing said quick-feed pulse signal;

a first flip-flop having a reset input connected to the output of said quick-feed input circuit at a first node for receiving said first output signal, having an input, and having an output;

a third NOR gate having an output connected to the input of said first flip-flop, having a first input connected to the output of said first flip-flop, and having a second input;

a second flip-flop having a reset input connected at said first node for receiving said first output signal, having an input connected to the output of said first flip-flop, and having an output;

a fourth NOR gate having a first input connected to the output of said second flip-flop, having a second input, and having an output;

an inverter circuit having an input connected to the output of said fourth NOR gate and having an output;

a fourth flip-flop having a reset input connected at said first node for receiving said first output signal, having an input connected to the output of said inverter circuit and having an output connected to the second input of said third NOR gate; and a second AND gate having a first input connected to said frequency divider circuit for receiving said second frequency divided signal, having a second input connected to the output of said fourth flip-flop and having an output connected to the second input of said fourth NOR gate.

* * * * *

UNITED STATES PATENT AND TRADEMARK OFFICE

CERTIFICATE OF CORRECTION

PATENT NO. : 4,280,213

DATED : July 21, 1981

INVENTOR(S) : Takahashi et al

It is certified that error appears in the above—identified patent and that said Letters Patent is hereby corrected as shown below:

Column 2, line 18, delete "is needed".
Column 2, line 47, "In Fig. 3" should be --Referring to FIGS. 3A and 3B--.
Column 2, lne 53, "$H_z$" should be --Hz--.

Signed and Sealed this

*Twenty-ninth* Day of *December 1981*

[SEAL]

*Attest:*

GERALD J. MOSSINGHOFF

*Attesting Officer*

*Commissioner of Patents and Trademarks*